US005765260A

United States Patent [19]

Judkins

[11] Patent Number: 5,765,260

[45] Date of Patent: Jun. 16, 1998

[54] DRAPERY WITH REMOVABLE HEADER

[76] Inventor: Ren Judkins, 46 Newgate Rd., Pittsburgh, Pa. 15202

[21] Appl. No.: 625,525

[22] Filed: Mar. 28, 1996

[51] Int. Cl.[6] ..... A47H 15/00

[52] U.S. Cl. ..... 16/93 D; 160/345

[58] Field of Search ..... 16/93 D; 160/330, 160/344, 345, 348

[56] References Cited

U.S. PATENT DOCUMENTS

| | | | |
|---|---|---|---|
| Re. 25,613 | 7/1964 | Truesdale | 160/330 |
| 661,608 | 11/1900 | Holtzclaw | 160/84.01 |
| 2,104,261 | 1/1938 | Landau | 160/330 |
| 3,369,589 | 2/1968 | Benkert, Jr. . | |
| 3,399,713 | 9/1968 | Wilson | 160/348 |
| 3,652,373 | 3/1972 | Noble | 160/330 |
| 4,915,153 | 4/1990 | Toti . | |

FOREIGN PATENT DOCUMENTS

| | | | |
|---|---|---|---|
| 0619970 A1 | 10/1994 | European Pat. Off. | 16/93 D |

*Primary Examiner*—A. L. Pitts
*Assistant Examiner*—Mark Williams
*Attorney, Agent, or Firm*—Buchanan Ingersoll, P.C.

[57] ABSTRACT

An apparatus for providing stiffness to the upper end of an elongated section of drapery fabric which selectably allows the drapery fabric to be readily foldable when stiffness is not needed. The apparatus also connects the drapery to an overhead, traverse supporting rail, such as by an arrangement of hooks and eyelets or rotatable pendants. The apparatus includes an insert member made of a flexible, relatively stiff material which may be one continuous strip or a series of segments. The apparatus also includes member mountable to the drapery that is made of flexible, readily-foldable material. The insert member and the mounting member are configured so that the insert member may be engaged with the mounting member. When the insert member is engaged with the mounting member, the insert member and mounting member are not readily foldable and provide stiffness to support the drapery fabric between pendants. When the insert member is disengaged from the mounting member, the entire drapery fabric, including the upper end of the drapery fabric to which the mounting member is attached is uniformly foldable.

31 Claims, 5 Drawing Sheets

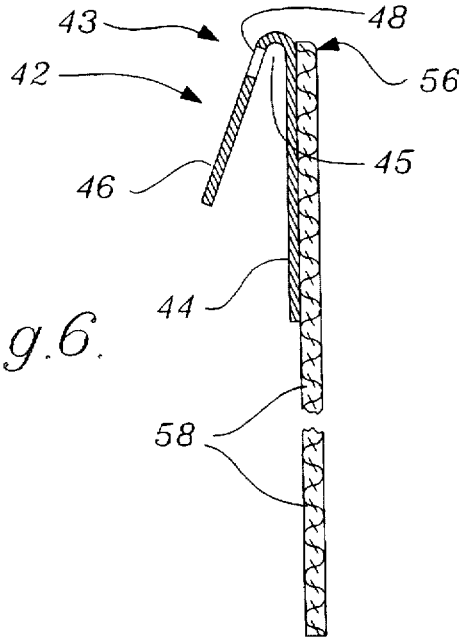
Fig.6.
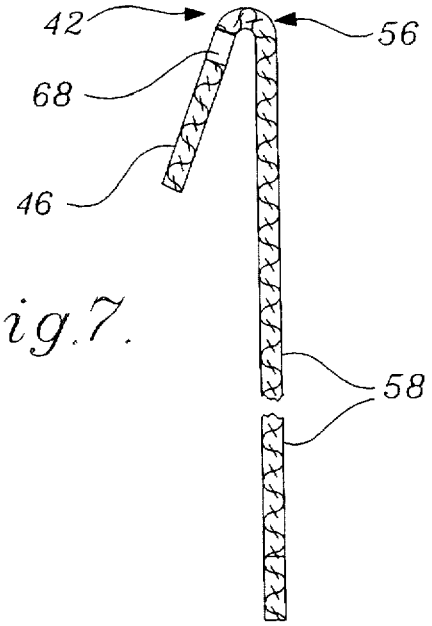
Fig.7.
Fig.8.
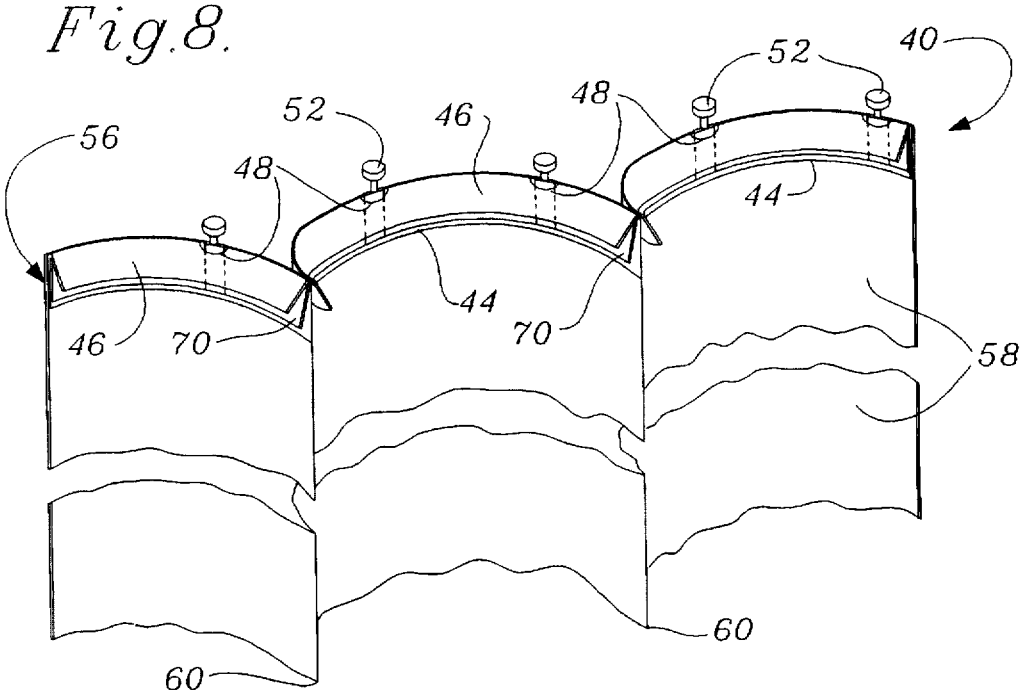
Fig.9.
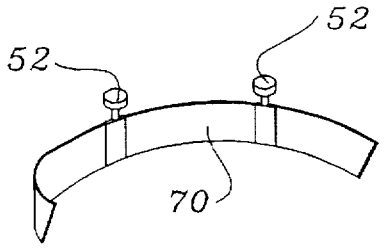

DRAPERY WITH REMOVABLE HEADER

BACKGROUND OF THE INVENTION

1. Field of the Invention

This invention relates generally to drapery and more particularly to an apparatus that can provide stiffness to drapery and will also allow the drapery to be easily folded during transportation.

2. Description of the Prior Art

Many homes, apartments and other dwellings use some type of window covering. Draperies, vertical blinds and venetian blinds are examples of well-known window coverings. Draperies are often preferred by consumers over vertical blinds and venetian blinds because they have a softer appearance. Draperies are elongated sections of fabric which are supported at their upper end by a number of eyelets, hooks, pins or other supporting means which are spaced along the top of the drapery fabric. The support means often are connected to carriers that are movable along an overhead track as described below. In this way, the drapery may be moved laterally along the track.

Draperies are available in a variety of materials, but drapery materials are preferred that are more readily foldable as these materials have a more soft appearance and may naturally fold over when the drapery is moved laterally to one side of the window when the drapery is opened. However, such readily foldable materials tend to sag at the plurality of supports along the upper end of the drapery. For this reason and for aesthetic purposes i.e., to provide a more full appearance, draperies require stiffness along their upper end to prevent sagging at the supports.

Heretofore in the industry, stiffness has been provided to the upper end of drapery fabric by permanently affixing sections of materials, such as by sewing, to the upper end of the drapery fabric. Most often, a continuous strip of material is sewn to the top of the drape in conjunction with a hem that may or may not wrap around the strip. Another method is to attach permanent extra sections of relatively stiff material between adjacent drapery fabric creases along the upper end of the drapery fabric. The extra sections of material are collectively referred to as "the header" of the drape. In this way, the drapery fabric may still fold along its creases but will maintain an unfolded, bowed, "full" appearance between creases.

The additional thickness imparted by this extra header makes folding, handling and shipping of the drapery fabric difficult. As with any other product, the transportation costs for drapery fabric are increased if each unit of product occupies a greater area during shipping. Thus, for shipping purposes, it would advantageous to be able to fold the drapery fabric into a compact unit and then box the folded down drapery fabric. However, the header makes folding of the drapery fabric difficult. When conventional drapery is stacked together, the width of the top of the drapery with the header is several times wider than the width of the middle of the drapery. As a result, it is difficult to box draperies and draperies are usually transported on hangers. Therefore, shipping of conventional drapery over long distance is difficult and is not very cost effective. For this reason, a great amount of drapery is produced or assembled in the local area in which it is sold.

It is clear that there is a desire in the industry to provide a "soft", readily foldable drapery fabric and yet to provide a full, not readily foldable upper end of that fabric. Conventional methods of accommodating these conflicting goals has resulted in the providing of extra sections of material permanently to the upper end of the drapery fabric. This conventional solution has resulted in inefficient transportation of the drapery and difficulty and expense to clean the draperies. For this reason, such drapery is very often manufactured and/or assembled in the local area where it is sold and must be professionally cleaned.

It would be advantageous, therefor, to provide a means for making the upper end of the drapery fabric relatively stiff to provide the drapery fabric with a full appearance and support between carriers and to provide such a means that would selectably allow the drapery fabric to be readily folded, handled or washed when stiffness is not needed or desired. Such means should enable use of existing methods and apparatus for supporting the drapery fabric and for opening or closing the drapery system which typically utilize the upper end of the drapery fabric. Therefore, a discussion of these existing methods and apparatus for supporting the drapery fabric and for opening or closing the drapery system would be useful.

A perspective view of a drapery system of the type currently known in the industry is shown in prior art FIG. 1. The drapery system 10 is comprised of a section of drapery fabric 12 having a series of vertical creases 13 provided thereon. Each of the vertical creases 13 point in the same direction (toward the wall or window being covered by the drapery). The drapery fabric has an upper end 20 which is connected to and supported by an overhead supporting rail 14. A pull cord 16 is attached to a master carrier (not shown) that runs through rail 14 and is used to selectively open and close the drapery.

A preferred means of supporting the drapery fabric and opening or closing the drapery system already known in the art is shown in to FIGS. 1 and 2. The overhead supporting rail 14 has two channels 15 and 17 disposed through its length. The slide channel 15 opens along the bottom of the supporting rail 14 substantially along the entire length of the supporting rail 14. A number of carriers 22 are disposed within the rail channel 15 so as to be movably engaged with the rail 14. Each carrier 22 has a generally H-shaped cross section that allows the carrier to slidably fit within the slide channel 15. Being H-shaped, the carrier has a wide slide portion 23 which is disposed within the rail channel 15. A spacer cord 11 runs between adjacent carriers 22.

A series of supporting means, which are typically pendants 18, are connected to the upper end 20 of the drapery fabric 12 and are also connected to the carriers 22. The pendants 18 can be connected to a strip 19 of nylon strap which is attached to the drapery fabric 20 by any convenient means such as by being snapped on, fastened with Velcro™ type fasteners, welded or sewn thereto. Each pendant has a body portion 24 which is affixed to the drapery fabric 12 and also has a head portion 26. The pendant head portion 26 is relatively enlarged and connects to the pendant body portion 24 by means of a relatively narrow neck 27.

The carriers 22 each have a base 30 having a mouth thereupon. The carrier mouth 28 is sized and configured so as to receive the neck 27 of the pendant 18, typically through a snap fit. The pendant head portions 26 prevent the pendant head 26 from moving vertically relative to the carriers 22 when the pendant head 26 is snap fit into the carrier 22. Yet, the pendant is free to rotate about a vertical axis through the neck.

In this way, each of the carriers 22 are connected through the pendant 18 to the drapery fabric upper end 20. The pull cord 16 is connected to the master carrier (not shown) which is connected to at least one of the carriers 22. Thus, when the pull cord is able to move the carriers and thus the drapery fabric 12 along the rail 14. When the pull cord is pulled in one direction the master carrier pushes the other carriers closer together and causing the drapery fabric to fold over itself and to be gathered at one end of the rail. The drapery system is then said to be in the open position. When the pull cord is pulled in the opposite direction, the master carrier pulls all the carriers until they are spaced fully apart from one another. Now the drapery system is said to be in the closed position.

In addition to pendants, other supporting means, such as a hook and eyelet arrangement, are also used. The system functions similarly with these other supporting means. For, example, a series of eyelets may be provided along the upper end of the drapery fabric. Then, a number of hooks are provided so that each hook may engage an eyelet and connect to the carrier. Or, a series of hooks can be provided along the upper end of the drapery fabric. Each hook then engages an eyelet upon a carrier. Preferably, the hook or eyelet can rotate about an axis through the hook or eyelet.

SUMMARY OF THE INVENTION

An apparatus is described and shown herein for providing stiffness to the upper end of an elongated section of drapery fabric. The apparatus of the present invention may also selectably allow for the drapery fabric to be readily foldable when stiffness is not needed or desired, such as during shipping or washing. Preferably, the stiffness-providing apparatus also functions to connect the upper end of the drapery to an overhead, traverse supporting rail of the type currently known in the industry having a plurality of carriers movably connected thereto. The movable carriers then are connected to the drapery through any suitable means, such as an arrangement of hooks and eyelets or, as is preferred, through use of a plurality of rotatable pendants.

The apparatus includes an insert member made of a flexible, relatively stiff material which may preferably be one continuous strip or a series of segments. The apparatus also includes a mounting member made of flexible, readily-foldable material which can be one continuous piece or preferably a series of segments. The mounting member has a portion that is attachable to an upper end of the drapery. The insert member and the mounting member are configured so that the insert member may be engaged with the mounting member. The materials for the insert member and the mounting member are chosen so that when the insert member is engaged with the mounting member, the insert member and mounting member are not readily foldable and provide stiffness to support the drapery fabric between the pendants. When the insert member is disengaged from the mounting member, the entire drapery fabric, including the upper end of the drapery fabric to which the mounting member is attached is uniformly foldable.

Either the insert member or the mounting member, and preferably the insert member, has attachment means connected thereto. The attachment means may be any suitable means for connecting the apparatus to the supporting member. The preferred attachment means is a plurality of pendants connected to the insert member. Alternatively, the attachment means may be a plurality of eyelets sized and configured to engage respective hooks attached to the carriers or a plurality of hooks sized and configured to engage respective eyelets attached to the carriers.

The mounting member and the insert member are configured so that the insert member may be selectably received by and connected to the mounting member. The mounting member is preferably made of a backing portion which is attachable to the drapery fabric and a plurality of flaps which are each provided between adjacent insert member creases when the insert member is received by the mounting member. The flaps each connect to the backing portion along an upper end of the backing portion. It is preferred that the flaps have one or more apertures disposed therethrough.

The mounting member and the insert member are preferably engaged with one another in the following way. The insert member is placed within and between the mounting member backing portion and the mounting member flaps. The attachment means (preferably the pendants) of the insert member are then preferably disposed through respective apertures when the mounting member receives the insert member. This is of great advantage in that the pendants and the apertures cooperate to allow for the insert member and the mounting member to be positively located with respect to one another.

The pendants are disposed through the apertures of the mounting member and are connected to the overhead supporting rail through the movable carriers. The weight of the drapery causes the mounting member to move downward relative to the insert member. At the same time, the insert member, to which the pendants are attached, is fixed in position. As the mounting member moves downward, the transverse crease of the mounting member will sit upon the upper edge of the insert member. The upper edge of the insert member will not be able to pass through the apertures and be held in position thereby.

The insert member preferably has a plurality of preformed, vertically-oriented creases transversely spaced thereupon. Preferably, the insert member creases each face a same direction when the insert member is received by the mounting member. It is further preferred that each of the insert member creases overlay a respective vertically-oriented crease provided upon the drapery when the insert member is in engagement with the mounting member and the mounting member is attached to the drapery.

The insert member is preferably made of a material that is stiff enough to support whatever fabric is chosen for the drapery, so that the drapery fabric does not sag. Acceptable insert materials for many of the drapery fabrics typically used in the industry include crinoline, fabric that has been stiffened, such as by being starched, material that has been coated or impregnated with plastic, woven materials, many plastics, such as polyester (Mylar™), polyethelene, nylon film, polypropelene, polyvinyl chloride and polycarbonate and cardboard.

The mounting member is made of any material that will readily fold, is not bulky and which is strong enough to support the drapery fabric around the apertures when the pendants are disposed through the mounting member apertures. The mounting member is preferably made of a plastic film, such as a Mylar™ film or vinyl.

As an alternative embodiment, the insert member may be a number of separate insert pieces as opposed to a single, unitary piece. In this embodiment, each insert is provided with an attachment means, which is disposed through a respective aperture in the mounting portion. When the inserts are engaged to the mounting portion, each insert is disposed between a respective pair of adjacent drapery creases. If separate segments are used to make the insert members, they preferably fasten together at their ends and the resulting connection coincides with the backward facing pleat of the fabric.

As another alternative embodiment, the mounting member may be integrally formed from the drapery fabric. Thus, the upper end of the drapery fabric has apertures provided therethrough and may have flaps formed thereon or may have loops woven in for a Velcro™ type connection.

Other objects and advantages of the invention will become apparent from a description of certain present preferred embodiments thereof shown in the drawings.

BRIEF DESCRIPTION OF THE DRAWINGS

FIG. 6 is a cross-sectional view of the mounting member of the present preferred apparatus taken along line VI—VI of FIG. 4.

FIG. 7 is a view similar to FIG. 6 of an alternative embodiment of the mounting member in which the mounting member is integral with the drapery fabric.

FIG. 8 is a perspective view of a portion of an alternative embodiment of the present preferred apparatus in which the insert member is comprised of a number of separate inserts.

FIG. 9 is a perspective view of an insert of the embodiment shown in FIG. 8.

DETAILED DESCRIPTION OF THE PREFERRED EMBODIMENTS

Figure 3:
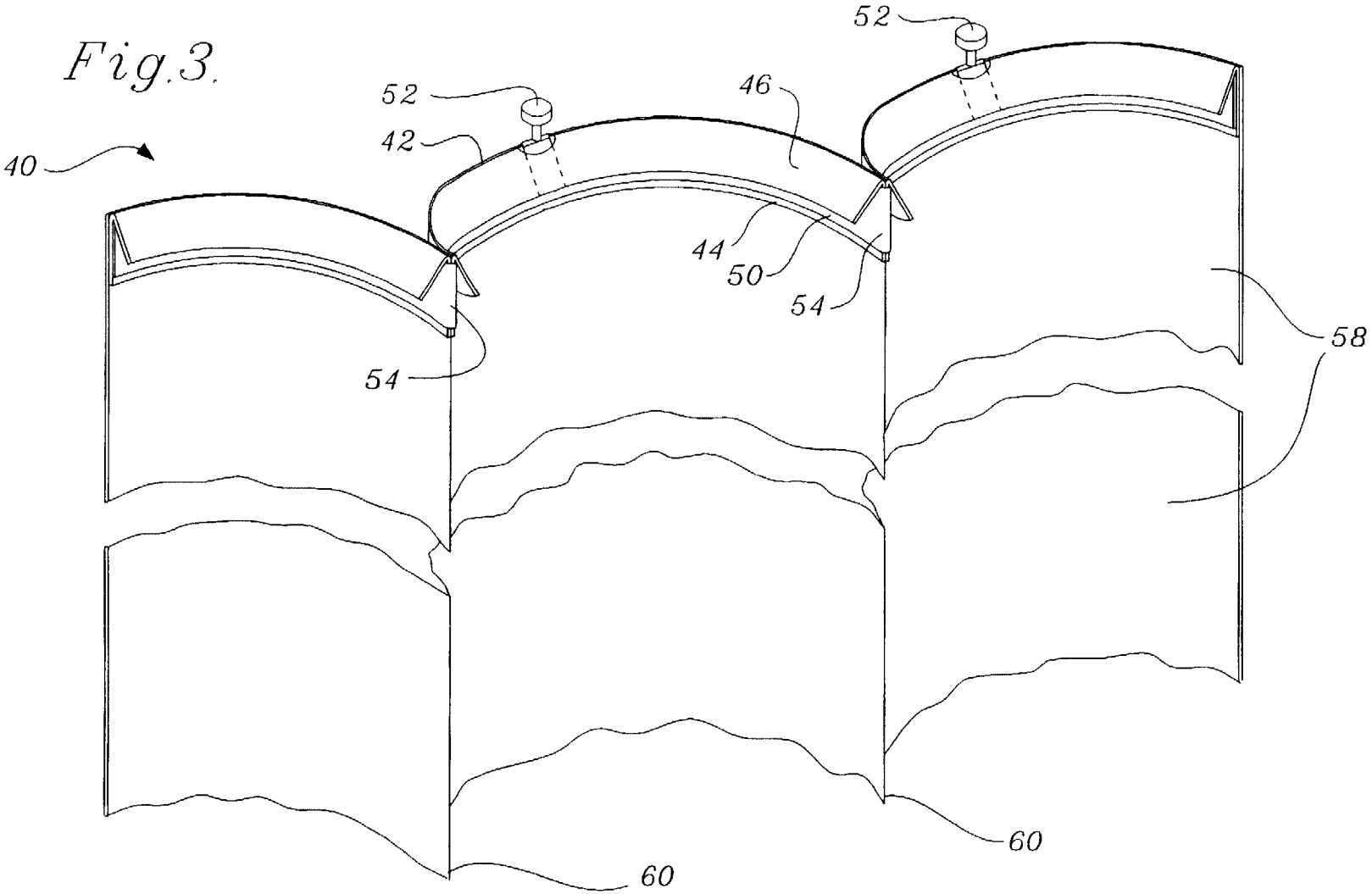
FIG. 3 is a perspective view of a portion of the present preferred apparatus for selectably providing stiffness to a drapery fabric, in which the insert member is engaged with the mounting member and in which the fabric is broken to indicate length.
Figure 4:
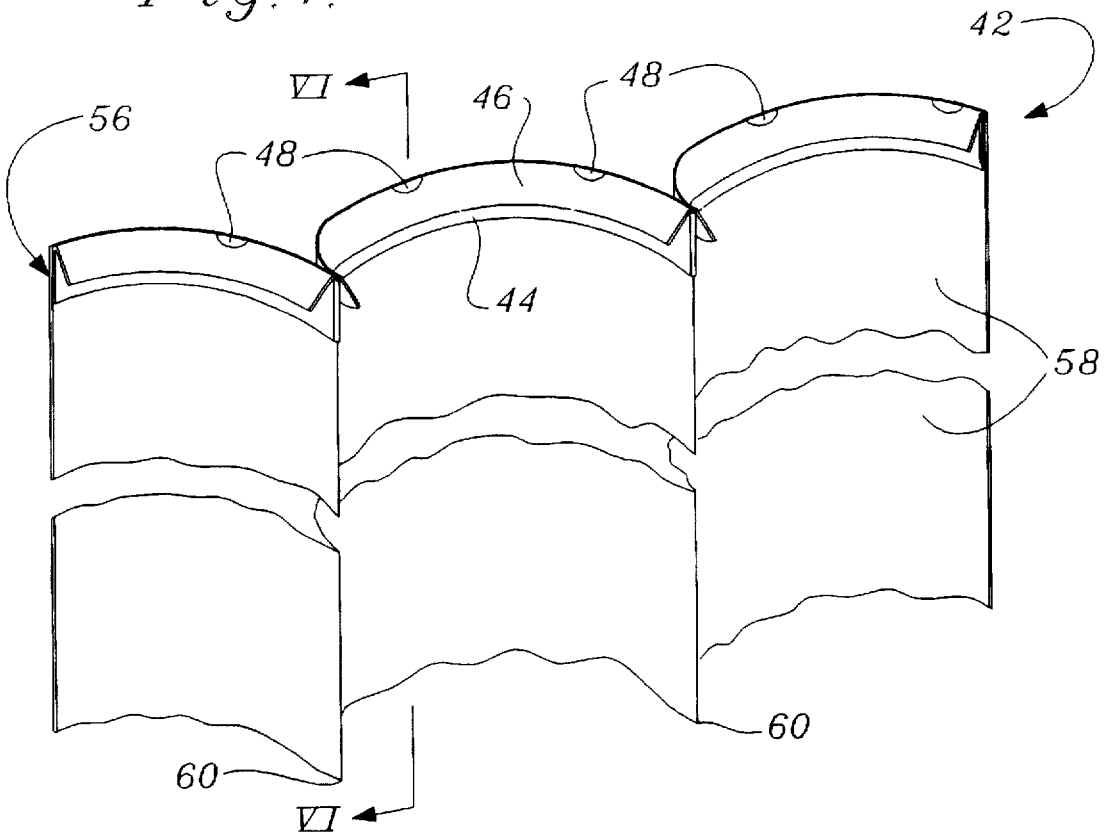
FIG. 4 is a perspective view of a portion of the present preferred apparatus for selectably providing stiffness to a drapery fabric showing the mounting member and a portion of the drapery fabric.
Figure 5:
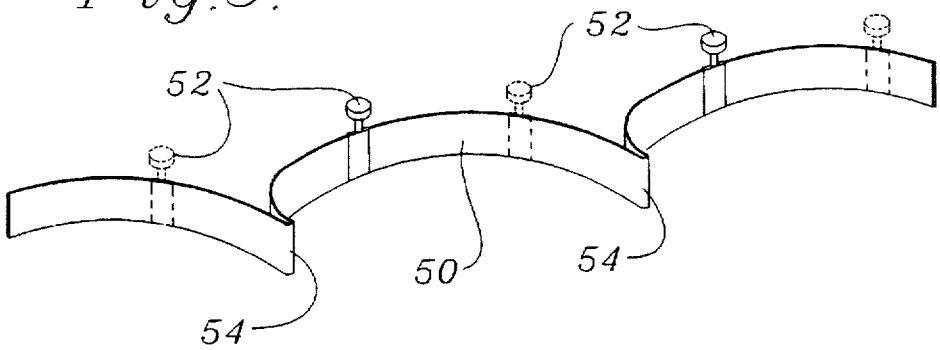
FIG. 5 is a perspective view of a portion of the present preferred insert member apparatus for selectably providing stiffness to a drapery fabric.

Referring first to FIGS. 3, 4 and 5, the present preferred apparatus 40 for providing stiffness to a drapery fabric of a drapery system is shown. The apparatus 40 has as its two main components a mounting member 42 and an insert member 50. The insert member 50 is preferably made of a relatively stiff material. The mounting member 42 is preferably made of a flexible, readily-foldable material.

The mounting member 42 has a portion that is attachable to an upper end 56 of the drapery fabric 58. The insert member 50 and the mounting member 42 are sized and configured so that the insert member 50 may be engageable with the mounting member 42 as described below. The materials from which the insert member 50 and the mounting member 42 are made are chosen so that when the insert member 50 is engaged with the mounting member 42, as shown in FIG. 3, the insert member 50 and the mounting member 42 are not readily foldable and provide stiffness to the upper end 56 of the drapery fabric 58. When the insert member 50 is disengaged from the mounting member 42, as shown in FIG. 4, the entire drapery fabric 58, including the drapery fabric upper end 56 to which the mounting member 42 is attached, are readily foldable and are not overly bulky.

The insert member 50 is preferably made of a material that is stiff enough to support whatever fabric is chosen for the drapery 58, so that the drapery fabric 58 does not sag. Acceptable insert materials for many of the drapery fabrics typically used in the industry include crinoline, fabric that has been stiffened, such as by being starched, material that has been coated or impregnated with plastic, woven materials, many plastics, such as polyester (Mylar™), polyethylene, nylon film, polypropylene, polyvinyl chloride and polycarbonate and cardboard.

The mounting member 42 is made of any material that will readily fold, is not bulky and which is strong enough to support the drapery fabric around the apertures when the pendants are disposed through the mounting member apertures. The mounting member 42 is preferably made of a plastic film, such as a Mylar™ film.

The mounting member 42 has a backing portion 44 which is affixed to the upper end 56 of a section of drapery fabric 58. The mounting member 42 further has a plurality of flaps 46 disposed transversely along the mounting member 42. Each flap has at least one aperture 48 disposed therethrough.

As can be seen best in FIG. 6, the flaps 46 connect to the mounting member backing portion 44 along an upper end 43 of the mounting member 42 forming a crease 45 upon the mounting member 42. Preferably, the mounting member apertures 48 are provided proximate to the mounting member creases 45.

Referring again to FIGS. 3, 4 and 5, the insert member 50 preferably has a plurality of vertically oriented creases 54 disposed transversely along the insert member 54. Preferably, attachment means 52 are provided upon the insert member 50. The preferred attachment means 52 is one or more pendants 52 which are connected to the insert member 50. It is preferred that a single pendant 52 is provided between adjacent insert member creases 54.

Figure 1:
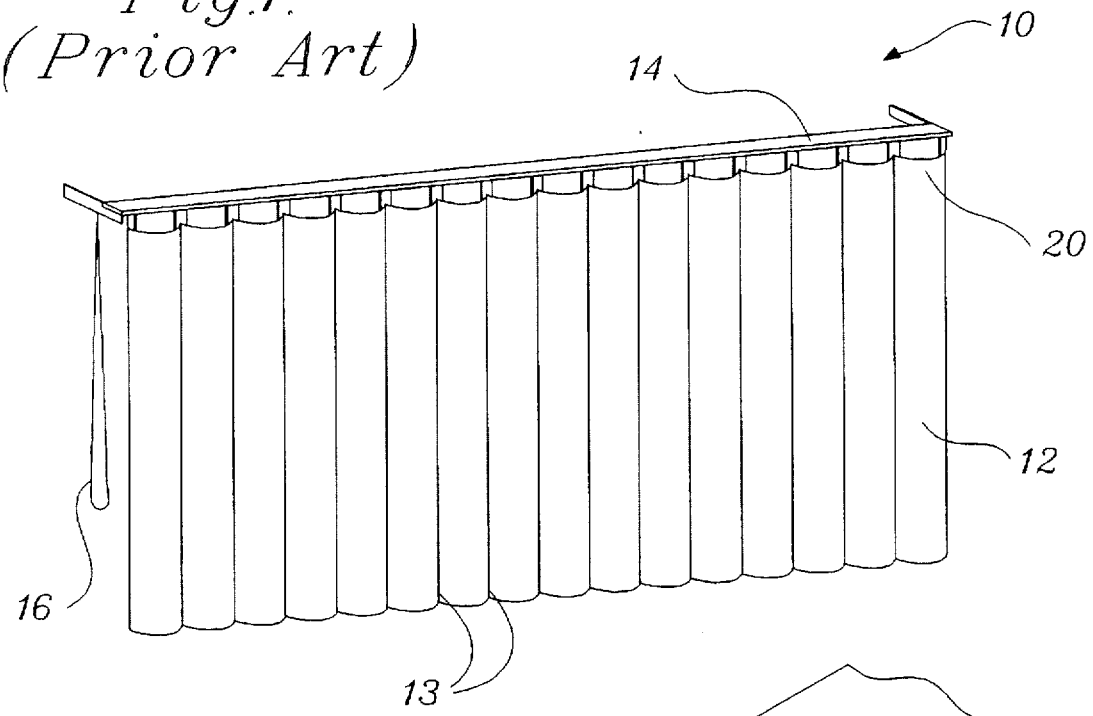
Fig.1. (Prior Art)
FIG. 1 is a perspective view of a prior art drapery system.
Figure 2:
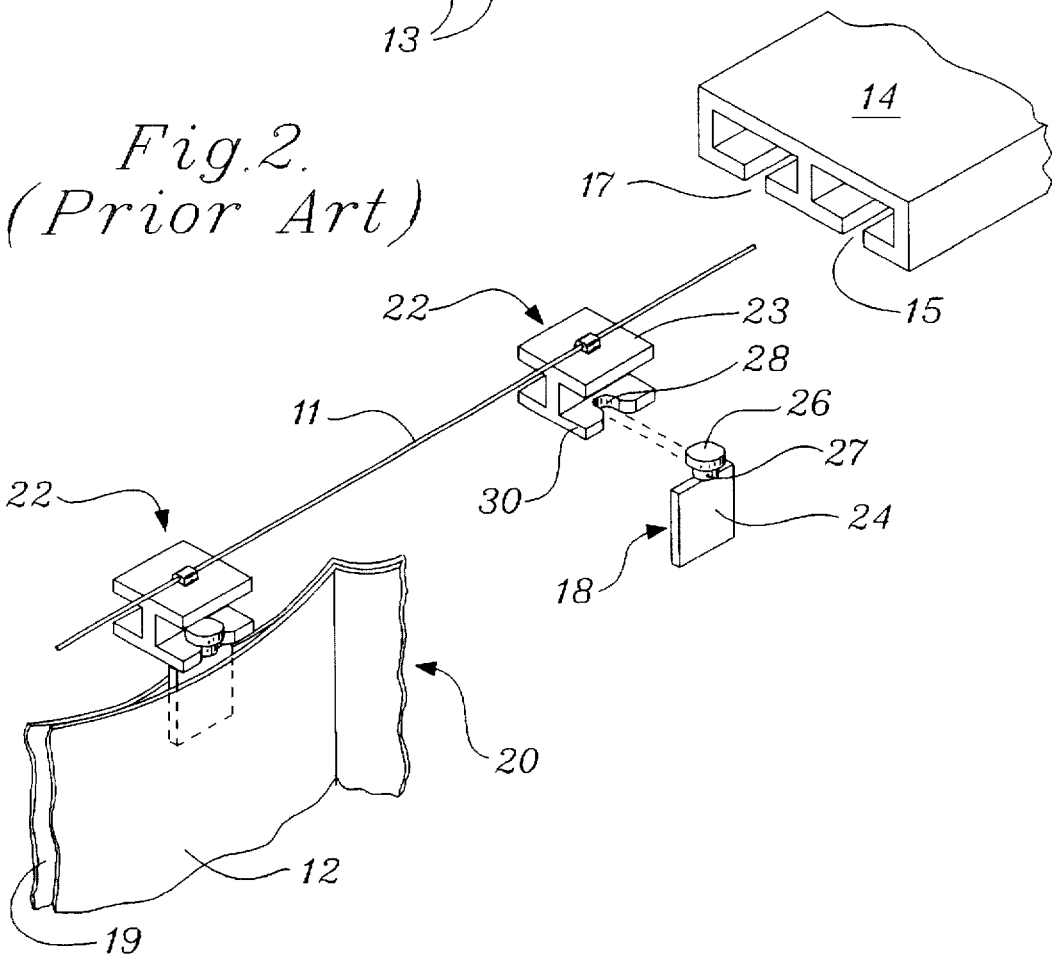
Fig.2. (Prior Art)
FIG. 2 is a perspective view showing a prior art means for mounting opening and closing the drapery fabric.

The pendants 52 are preferably generally similar in configuration and function as the pendants 18 disclosed in prior art FIG. 2. In this way, the present preferred system for providing stiffness to the upper end of the drapery may be used with existing means utilized in the industry for supporting and moving drapery fabric, as described herein with reference to FIGS. 1 and 2. The pendants 52 may be connected to the insert member 50 by any convenient means, such as by being affixed thereto by an adhesive.

The insert member 50 and the mounting member 42 are configured so that the pendants 52 may be disposed through respective apertures 48 in the mounting member 42. The insert member 50 is engaged with the mounting member 42 preferably by being placed within and between the mounting member backing portion 44 and the mounting member flaps 46, and by the pendants 52 (which are attached to the insert member 50) being disposed through apertures 48.

The pendants 52 are connected to a supporting rail through carriers (not shown in FIG. 3) of the type known in the industry such as are described and shown in FIGS. 1 and 2. One or more pendants 52 are provided between each crease 54 as shown in FIG. 5. Alternatively, the mounting member may be a set of distinct segments 70 which fit between creases 60 of the drapery fabric 58 as shown in FIG. 8. One or more pendants 52 can be provided on each segment 70 as shown in FIGS. 8 and 9. When the pendants 52 are thus connected to the supporting rail, the weight of the drapery fabric 58 will pull the mounting member 42 downward so that the insert member 50 will be snugly wedged into the mounting member creases 45. Thus, in this way, the insert member 50 will support the mounting member 42 and thus the drapery fabric and prevent the drapery fabric from moving downward.

The drapery fabric 58 with which the presently preferred apparatus is used is of the type currently known in the industry and described above with reference to FIGS. 1 and 2. Thus, the drapery fabric 58 usually has a plurality of preformed, vertically-oriented creases 60 transversely spaced thereupon. The creases 60 in the drapery fabric 58 are formed by means well known in the industry, such as by ironing, machine pleating, stitching or welding the drapery fabric 58. It is preferred that the flaps 46 of the mounting member 42 be provided between a pair of adjacent drapery creases 60. Thus, the flaps 46 preferably do not extent over the drapery creases 60.

The insert member 50 preferably also has a plurality of preformed, vertically-oriented creases 54 transversely spaced thereupon. Preferably, the insert member creases 54 each face a same direction along the insert member 50. It is further preferred that the insert member creases 54 correspond in location and spacing to the creases 60 provided upon the drapery fabric 58. Therefore, the creases 54 of the insert member 50 each overlay a respective crease 60 provided upon the drapery fabric 58, when the insert member 50 is in engagement with the mounting member 42 and the mounting member 42 is attached to the drapery fabric 58. In this way, the drapery fabric 58 may be allowed to fold about its creases 60 when the drapery system 10 is opened.

I have found that a Mylar plastic insert with equally spaced creases will maintain a uniform pleat appearance along the length of the drapery at all times. That is when the drapery, if fully open, fully closed or partially closed, the pleats along this header will appear to all be of the same size and fullness.

Variations of the preferred embodiments could be made. For, example, the insert member and the mounting member could be held in engagement with one another by any convenient means such as through corresponding sections of hook and loop type fastening material (known generally as Velcro™ fasteners).

Referring to FIG. 7, an alternative embodiment is shown in which the mounting member 42 is integral with and is formed from the drapery fabric 58. In this embodiment, the upper end 56 of the drapery fabric 58 also preferably has flaps 66 formed thereon. Each flap 66 preferably has one or more apertures 68 provided therethrough. This embodiment otherwise functions in the same manner as the present preferred embodiment described herein.

Referring next to FIGS. 8 and 9, another alternative embodiment of the present invention is shown. In this embodiment, the insert member is comprised of a number of separate inserts 70. Each insert 70 is preferably disposed between adjacent drapery creases 60 so that the inserts 70 do not extend over the drapery creases 60. In this way, the inserts 70 will not interfere with the folding of the drapery fabric 58 at the fabric creases 60 such as when the drapery system 10 is opened. This embodiment otherwise operates in the same fashion as the preferred embodiment described herein. Thus, the attachment means 52 is provided upon each insert 70 and is preferably disposed through a mounting member aperture 48 when each insert 70 is engaged with the mounting member 42.

Figure 10:
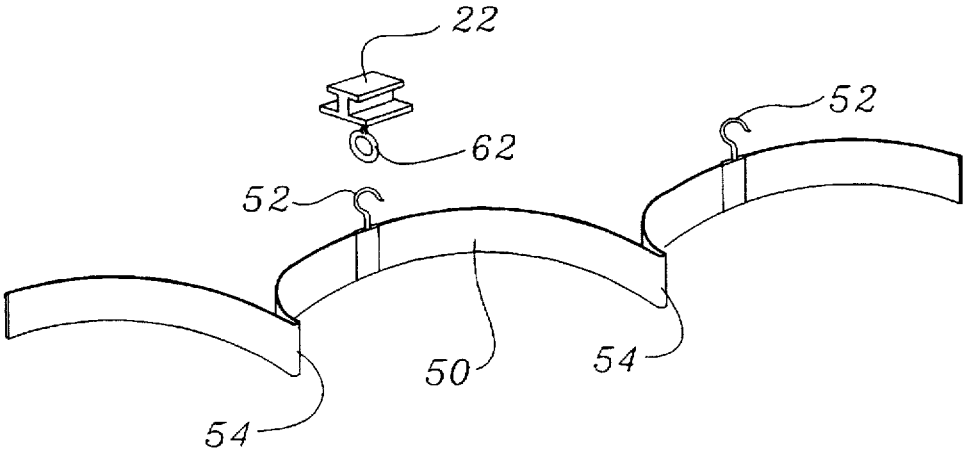
FIG. 10 is a front view of a portion of an insert member of the present preferred apparatus having an alternative attachment means connected thereto.
Figure 11:
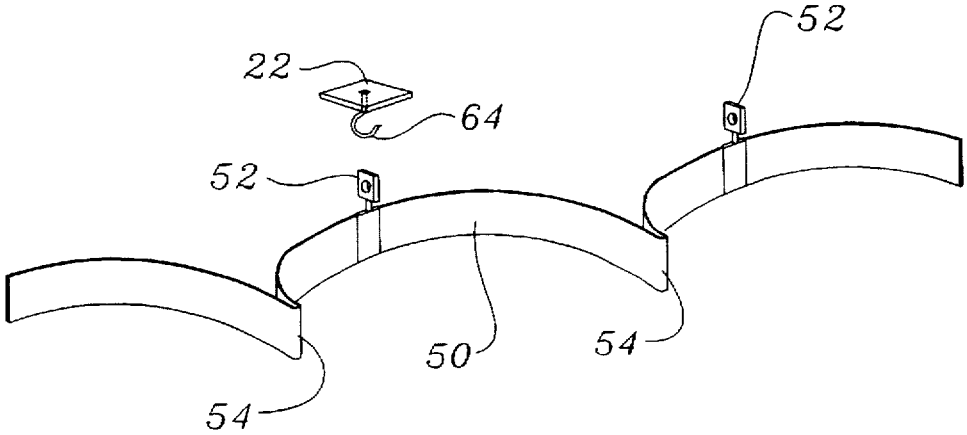
FIG. 11 is a front view of a portion of an insert member of the present preferred apparatus having another alternative attachment means connected thereto.

Although pendants are the preferred attachment means 52, other means may be employed. Referring to FIG. 10, the attachment means 52 may be a plurality of hooks sized and configured to engage respective eyelets 62 rotatably attached to the carriers 22. Moreover, referring to FIG. 11, the attachment means 52 may be a plurality of eyelets sized and configured to engage respective hooks 64 rotatably attached to the carriers 22. In any event, it is preferred that the attachment means be connected to the insert member and be disposed through a respective aperture of the mounting member. However, the attachment means 52 may be connected to the mounting member and the insert member may engage the mounting member such as by the insert member having apertures provided therethrough, through which the attachment means is disposed (in a fashion similar to what is shown and described with reference to the preferred embodiment).

While certain present preferred embodiments have been shown and described, it is distinctly understood that the invention is not limited thereto but may be otherwise embodied within the scope of the following claims.

I claim:

1. An apparatus for providing stiffness to an upper end of an elongated drapery, comprising:

a mounting member made of flexible, readily-foldable material, wherein the mounting member has a backing portion having an upper edge, the backing portion being connectable to the drapery transversely at an upper end of the drapery, and a plurality of flaps having one edge attached to the upper edge of the backing portion and an unattached opposite edge; and an insert member made of a flexible, stiff material removably attached to the mounting member between the backing portion and the flaps.

2. The apparatus of claim 1 wherein at least one attachment means is connected to the mounting member and configured for attachment to a carrier.

3. The apparatus of claim 1 wherein at least one attachment means is connected to the insert member and configured for attachment to a carrier.

4. The apparatus of claim 3 wherein the at least one attachment means is a plurality of spaced pendants.

5. The apparatus of claim 4 wherein the pendants are connected to the insert member and wherein the mounting member is provided with apertures therethrough, such that the pendants are disposed through respective apertures when the mounting member engages the insert member.

6. The apparatus of claim 3 wherein the at least one attachment means is selected from the group consisting of a plurality of eyelets sized and configured to engage respective hooks, and a plurality of hooks sized and configured to engage respective eyelets.

7. The apparatus of claim 1 wherein the insert member has a plurality of preformed, vertically-oriented creases spacedly transversely thereupon.

8. The apparatus of claim 7 wherein the plurality of insert member creases are all directed in a same direction.

9. The apparatus of claim 8 wherein the insert member creases are positioned to each overlay a respective preformed, vertically-oriented crease provided upon the drapery when the insert member is received by the mounting member and the mounting member is attached to the drapery.

10. The apparatus of claim 1 wherein the mounting member is formed as a separate piece that is attachable to the drapery.

11. The apparatus of claim 10 wherein the plurality of flaps are spaced transversely along the mounting member such that each flap is provided between selected insert member creases when the insert member is received by the mounting member.

12. The apparatus of claim 11 wherein at least one attachment means is connected to the mounting member and configured for attachment to a carrier.

13. The apparatus of claim 11 wherein at least one attachment means is connected to the insert member and configured for attachment to at least a carrier.

14. The apparatus of claim 13 wherein the at least one attachment means is selected from the group consisting of a plurality of eyelets sized and configured to engage respective hooks, a plurality of hooks sized and configured to engage respective eyelets, and a plurality of spaced pendants.

15. The apparatus of claim 13 wherein the flaps are provided with respective apertures therethrough, such that an attachment means is disposed through a respective aperture when the mounting member receives the insert member.

16. The apparatus of claim 1 wherein the insert member is made of a material selected from the group consisting of crinoline, starched fabric, plastic coated fabric, plastic impregnated fabric, woven fabric, polyester, polyethylene, nylon, polypropylene, polyvinyl chloride, polycarbonate and cardboard.

17. The apparatus of claim 1 wherein the insert member and the mounting member are engageable with one another through sections of hook and loop type fastening material provided thereon.

18. The apparatus of claim 1 wherein the mounting member is formed from and is integral with the drapery.

19. The apparatus of claim 18 wherein the plurality of flaps are spaced transversely along the mounting member such that each flap is provided between selected insert member creases when the insert member is received by the mounting member.

20. The apparatus of claim 19 wherein selected flaps are provided with at least one aperture disposed therethrough.

21. The apparatus of claim 20 wherein at least one attachment means is configured for attachment to at least one rod and a carrier connected to the insert member, and wherein the at least one attachment means is disposed through a respective aperture when the mounting member receives the insert member.

22. The apparatus of claim 21 wherein the attachment means is selected from the group consisting of a plurality of eyelets sized and configured to engage respective hooks, a plurality of hooks sized and configured to engage respective eyelets, and a plurality of spaced pendants.

23. The apparatus of claim 1 wherein the insert member is comprised of a plurality of separate inserts.

24. The apparatus of claim 23 wherein the pendants are connected to the insert member and wherein the mounting member is provided with apertures therethrough, such that the pendants are disposed through respective apertures when the mounting member engages the insert member.

25. The apparatus of claim 24 wherein the at least one attachment means is selected from the group consisting of a plurality of eyelets sized and configured to engage respective hooks, and a plurality of hooks sized and configured to engage respective eyelets.

26. The apparatus of claim 24 wherein the drapery has a plurality of preformed, vertically-oriented creases provided thereon and each insert is engaged to the mounting portion between a respective pair of adjacent drapery creases.

27. A drapery comprised of a panel of drapery material having an upper edge and an elongated header made of a flexible material removably attached to the panel of drapery material adjacent the upper edge, wherein the panel of drapery material has a plurality of spaced apart apertures along the upper edge and also comprising a plurality of pendants attached to the header and positioned so that one pendant passes through each aperture.

28. The drapery of claim 27 also comprising means for attaching the drapery to a carrier, the means being attached to the header.

29. The drapery of claim 27 wherein the header is attached to the drapery by hook and loop type fastening material provided thereon.

30. The drapery of claim 27 wherein there is an equal number of apertures and pendants.

31. A drapery comprised of:

a panel of drapery material having an upper end;

a mounting member made of flexible, readily-foldable material, wherein the mounting member has a backing portion having an upper edge, the backing portion being connected to the drapery transversely at an upper end of the drapery, and a plurality of flaps having one edge attached to the upper edge of the backing portion and an unattached opposite edge; and an insert member made of a flexible, stiff material removably attached to the mounting member between the backing portion and the flaps.

* * * * *

UNITED STATES PATENT AND TRADEMARK OFFICE

CERTIFICATE OF CORRECTION

PATENT NO. : 5,765,260
DATED : June 16, 1998
INVENTOR(S) : REN JUDKINS

It is certified that error appears in the above-indentified patent and that said Letters Patent is hereby corrected as shown below:

Column 8, claim 1, line 30, delete "stiff".

Column 8, claim 7, line 53, change "spacedly" to —spaced—.

Column 10, claim 31, line 44, delete ", stiff".

Signed and Sealed this

Twenty-ninth Day of September, 1998

*Attest:*

Bruce Lehman

BRUCE LEHMAN

*Attesting Officer*

*Commissioner of Patents and Trademarks*